US008105556B2

(12) United States Patent
Romanauskas et al.

(10) Patent No.: US 8,105,556 B2
(45) **Date of Patent: *Jan. 31, 2012**

(54) CENTRIFUGE ADAPTER AND CLOSURE

(75) Inventors: William A. Romanauskas, Southbury, CT (US); Edward T. Sheeran, Southbury, CT (US); Frank Eigemeier, Osterode-Dorste (DE)

(73) Assignee: Thermo Electron LED GmbH, Langenselbold (DE)

( * ) Notice: Subject to any disclaimer, the term of this patent is extended or adjusted under 35 U.S.C. 154(b) by 687 days.

This patent is subject to a terminal disclaimer.

(21) Appl. No.: 11/314,825

(22) Filed: Dec. 22, 2005

(65) Prior Publication Data

US 2008/0045395 A1 Feb. 21, 2008

(30) Foreign Application Priority Data

Dec. 23, 2004 (DE) ..... 10 2004 062 233

(51) Int. Cl.
*B04B 5/04* (2006.01)
*B65D 41/04* (2006.01)

(52) U.S. Cl. ..... 422/548; 422/547; 422/549; 422/550; 422/568; 220/315; 220/318

(58) Field of Classification Search ..... 292/336.3; 220/200, 288, 298, 299, 300–302, 304, 315, 220/318, 324, 326; 215/200, 329–332, 334, 215/335, 341, 345, 356, 316–318, 321, 322, 215/327; 422/99, 102, 104, 547, 548, 549, 422/550, 568

See application file for complete search history.

(56) References Cited

U.S. PATENT DOCUMENTS

| | | | | |
|---|---|---|---|---|
| 3,115,460 | A | 12/1963 | McCormick | |
| 3,377,021 | A | 4/1968 | Fox et al. | |
| 3,434,615 | A | 3/1969 | Barletta | |
| 3,635,370 | A | 1/1972 | Romanauskas | |
| 4,342,419 | A | 8/1982 | Conway | |
| 4,387,822 | A | 6/1983 | Lynn | |
| 5,036,996 | A * | 8/1991 | Epstein | 220/316 |
| 5,411,465 | A | 5/1995 | Glen et al. | |
| 5,458,252 | A | 10/1995 | Logel | |
| 5,527,257 | A | 6/1996 | Piramoon | |

(Continued)

FOREIGN PATENT DOCUMENTS

DE 29 42 807 A1 5/1980

(Continued)

OTHER PUBLICATIONS

United Kingdom Intellectual Property Office, Examination Report, Application No. GB0526399.1, dated Dec. 6, 2007 (2 pages).
German Patent and Trademark Office, Office Action, Application No. 10 2004 062 233.7, dated Sep. 28, 2005 (3 pages).

*Primary Examiner* — Jill Warden
*Assistant Examiner* — Cedric Chan
(74) *Attorney, Agent, or Firm* — Wood, Herron & Evans, LLP

(57) ABSTRACT

An adapter for taking up a sample container and for use in a laboratory centrifuge rotor, the adapter including a closed end, an opened end and closure assembly that releasably seals the opened end. The closed end and the opened end can be of a certain diameter. The adapter can also be a certain shape. The closure assembly can also include a handle, flange, a hold down ring, a sealing ring and bottom support for the sealing ring, hold down ring, flange and handle.

16 Claims, 11 Drawing Sheets

U.S. PATENT DOCUMENTS

| | | | | |
|---|---|---|---|---|
| 5,901,873 | A | 5/1999 | Moore | |
| 6,872,358 | B2 * | 3/2005 | Hagen et al. | 422/61 |
| 7,270,787 | B2 * | 9/2007 | Romanauskas et al. | 422/100 |
| 2005/0145378 | A1 * | 7/2005 | Mori et al. | 165/157 |

FOREIGN PATENT DOCUMENTS

| | | | |
|---|---|---|---|
| DE | 10 2004 036 966 | A1 | 3/2005 |
| EP | 139289 | A1 * | 5/1985 |
| EP | 0 943 370 | A2 | 9/1999 |

* cited by examiner

CENTRIFUGE ADAPTER AND CLOSURE

CROSS-REFERENCE TO RELATED APPLICATIONS

The present application claims priority of German Application No. 10 2004 062 233.7, filed Dec. 23, 2004, the entire contents of which are incorporated herein by reference.

FIELD OF THE INVENTION

The present invention relates to an adapter for taking up a sample container and for use in a laboratory centrifuge. The term "adapter" in the following description refers to sleeve-type receptacles into which sample containers can be inserted. The adapters can in turn be inserted into centrifuge rotors.

BACKGROUND OF THE INVENTION

A centrifuge rotor is a relatively massive member in which a liquid sample is exposed to a centrifugal force field. The liquid sample is carried in a sample container. For supporting the sample container and for stabilizing the rotor, sleeve-type adapters are known that are designed for taking up the sample containers. The adapters can in turn be inserted into a vertical or fixed angle centrifuge rotor. Such adapters are known, for example from the U.S. Pat. No. 5,411,465.

The sample can often contain a biologically hazardous material whose escape from the adapter can pose a health or safety hazard to the user of the centrifuge instrument.

In order to prevent the leakage or spraying of the liquid, containers are known in which O-ring members are typically used to ensure sealed engagement between the container and its cover. The O-ring seal is usually disposed in a circumferentially extending groove located at the open end on the container. The location of this groove exposes it to damage due to handling which also contributes to the leakiness of the container.

In addition, in conventional closures of a centrifuge container, a "crush" O-ring seal is used that is dependent on the torque applied to the closure and is therefore variable. This variability contributes greatly to the leakiness of the container.

In view of the foregoing, the object of the present invention is to specify an adapter and also a method that improve the safety and handling of centrifuge adapters.

SUMMARY OF THE INVENTION

According to one aspect of the present invention, an adapter and a closure are specifically designed so as to minimize distortion of the sealing area by eliminating all unnecessary support interfaces and thus their associated dimensional tolerances. The closure is preferably manufactured at least partly from high-strength, transparent plastic so that operating personnel can detect, even before opening the adapter, whether the sample container located in the adapter is damaged and whether any potentially biologically hazardous material has leaked into the internal space of the adapter.

Furthermore, it is preferred that the entire length of the adapter is of one diameter and that the adapter is completely supported by the rotor cavity. This requires that the container closure fit inside the container rather than on the outside of the necked down portion as in present designs.

The adapter can basically have any shape. The adapter is preferably designed with a cylindrical, elliptical or trapezoid shape.

According to another aspect of the present invention, a simple O-ring piston seal having an O-ring groove to minimize void volume and having an outer diameter as large as possible is used as the sealing element. The reason for this is that the operating centrifugal body forces acting on the O-ring material will force it into any existing void volume resulting from groove design, tolerances, recesses and distortion at the greatest distance from the rotational axis. If void volume is filled on the outer side, the O-ring cross-sectional area is reduced on the inner side. In conventional designs of sample containers, because of smaller neck diameters the inner side is also under fluid pressure resulting in potential leaks on the inner side. In the design of the present invention, the reduced inner section of the O-ring is not subjected to any fluid pressure whatsoever even if, for example a sample container breaks into pieces inside the adapter and liquid penetrates the interior of the adapter.

According to yet another aspect of the present invention, an interrupted bayonet type closure is used in order to avoid both having to decant fluid over the closure retainer threads, in the case of a broken sample container, and also having to use multiple closure turns to effect a seal. The completeness of the closure and open position is determined by positive stops. A conventional piston type O-ring seal does not allow easy insertion of a closure due to the required O-ring cross-sectional squeeze needed to effect a seal and due to the cumulative fit tolerances. In order to overcome this, a spring element is incorporated to provide a transverse squeeze to effect the seal. In one embodiment the transverse squeeze is applied by a threaded element. The resulting seal is dynamic in that the greater the pressure to be sealed, the greater the resulting sealing force. A flexible ring is also incorporated in the closure to completely encapsulate the O-ring thus eliminating the potential for the O-ring material to extrude from the O-ring groove.

According to another aspect of the present invention, the adapter is manufactured at least partly from metal or a metal alloy. By the use of metal or a metal alloy, a self-supporting structure of the adapter is ensured and the stability of the adapter is improved. A safer operation of the rotor is thus possible on the whole. Examples of the metals that can be used include steel, aluminum or titanium.

Alternatively or additionally, the adapter is manufactured at least partly from carbon fiber composite material. The weight of the adapter can thus be reduced and simultaneously a high stability can be achieved. It is preferred to manufacture those areas of the adapter that are designed using carbon fiber composite design using "winding technology." Here the adapter or portions thereof made of carbon fibers are wound around a reel core. The adapter can basically be manufactured completely from metal or from carbon fiber composite material. In addition, a combination of both the materials is also possible. A safe centrifugation is ensured even in the manufacturing process using the carbon fiber composite design.

For increasing the stability of the adapters and thus for improving the safety of the centrifugation, it is expedient for the adapter to be built at least in certain places from an inner jacket and an outer jacket resting against the inner jacket. This two-layer design (hybrid design) further improves the adapter stability. The adapter can basically be designed completely from two layers or can have the two-layer design only in certain places for reinforcing certain adapter parts. In this embodiment, the inner jacket is preferably formed out of a sleeve, also called "liner." The liner can be manufactured from metal or plastic and can have varying wall thicknesses in the rotor radial direction and in the rotor circumferential direction. The outer jacket is preferably manufactured from carbon fiber composite material. The carbon fibers are wound around the liner. The liner can basically fill out the entire inner surface of the adapter or can be fitted only in certain portions for reinforcing the adapter.

In addition, it is preferred to design a part of the closure assembly such that it is integrated into the inner jacket. Due to this, the number of individual parts of the adapter can be reduced, thus facilitating design and handling. For the integrated design, it is expedient that one liner is disposed at least in the area of the open end of the adapter. It is preferred to design the bottom with the associated thread in the liner. Furthermore, the flange can also be designed such that it is integrated into the liner.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology used herein, as well as the abstract, are for the purpose of description and should not be regarded as limiting.

As such, those skilled in the art will appreciate that the conception upon which this disclosure is based may readily be utilized as a basis for designing other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
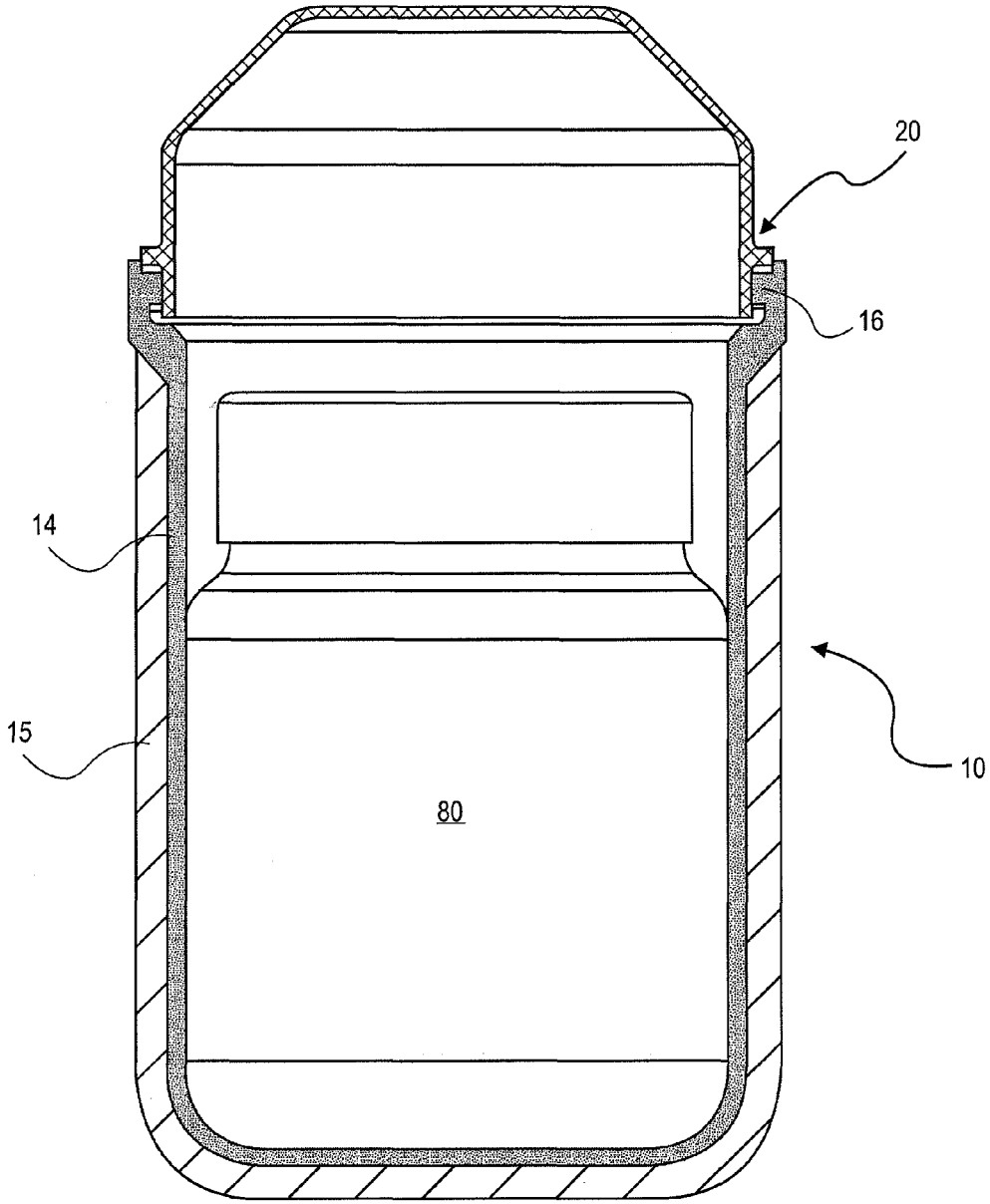
FIG. 1 is a cut lateral view of an adapter manufactured using the hybrid design and having an inserted sample container.

The invention will now be described with reference to the drawing figures, in which like reference numerals refer to like parts throughout. An embodiment according to the present invention provides an adapter and a closure specifically designed to minimize distortion of the sealing area by eliminating all unnecessary support interfaces and thus their associated dimensional tolerances.

FIG. 1 illustrates the cut lateral view of an adapter 10. The adapter 10 is closed with a closure assembly 20 and is sealed in a bio-proof manner. In the interior of the adapter 10, a sample container 80 is disposed that can be inserted into the adapter 10 with positive locking. Furthermore, it must be understood that the adapter 10 is manufactured from a 2-layer design and comprises an inner jacket 14 and an outer jacket 15 that rests against the inner jacket. The inner jacket is formed out of a liner that is manufactured from metal and around which carbon fiber material forming the outer jacket 15 is wound. The liner is provided with a continuous design and it thus covers the entire inner surface of the adapter 10. In the area of the open end of the adapter 10, a part of the closure assembly 20, namely a thread 16, is designed such that it is integrated into the liner.

Figure 2:
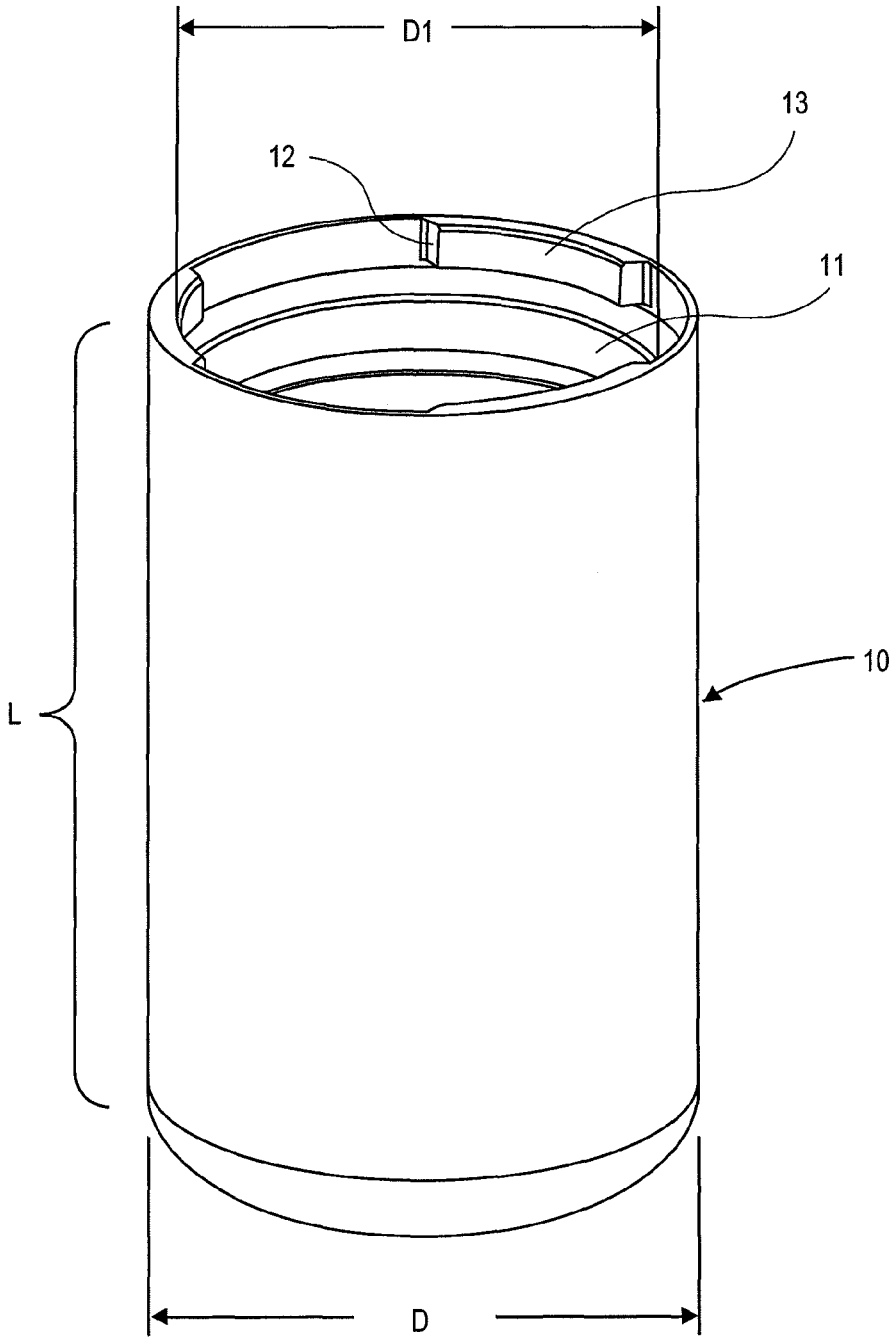
FIG. 2 is an adapter according to one embodiment of the present invention.
Figure 3:
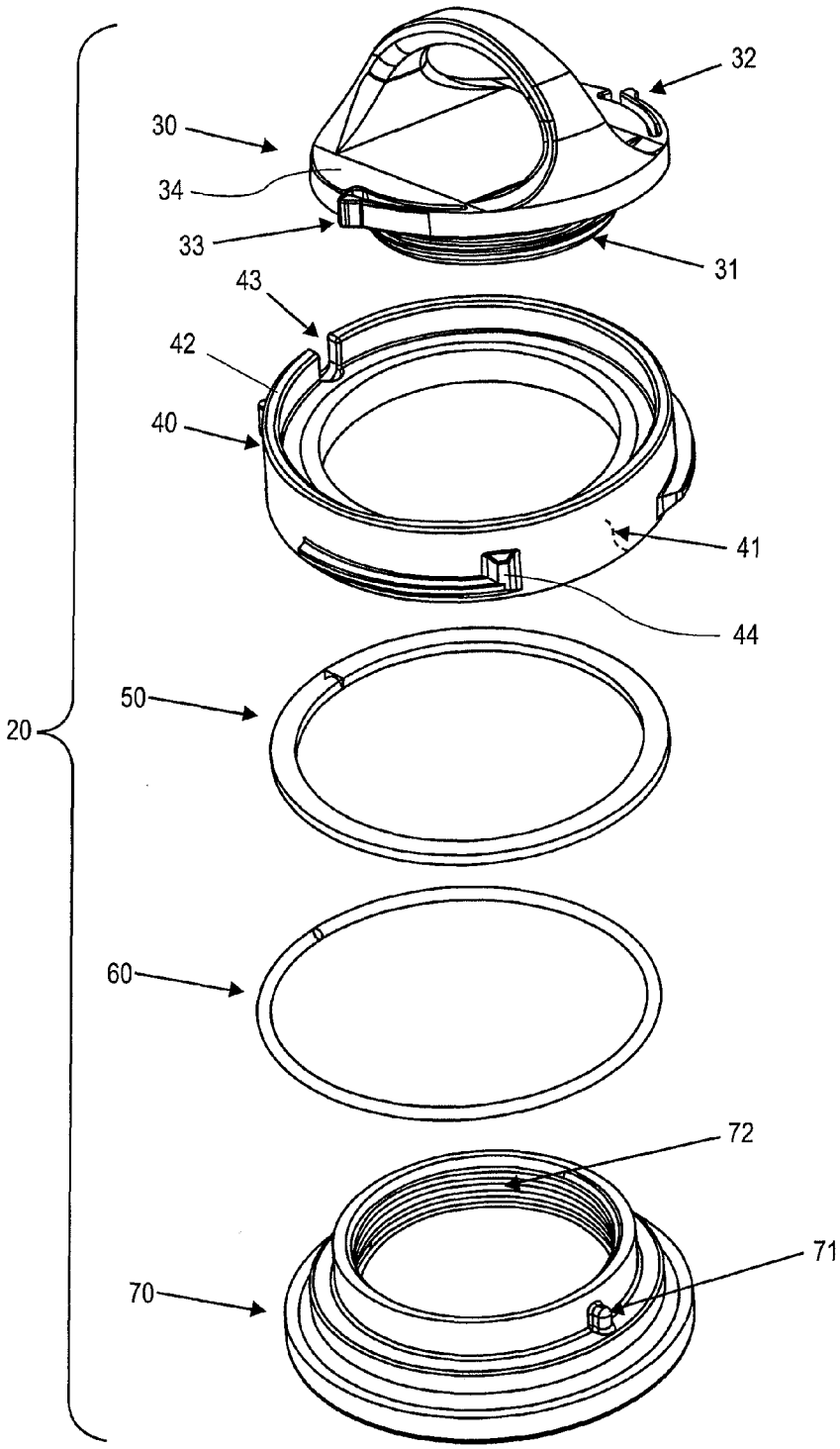
FIG. 3 is an exploded view of a closure assembly according to one embodiment of the invention.
Figure 4:
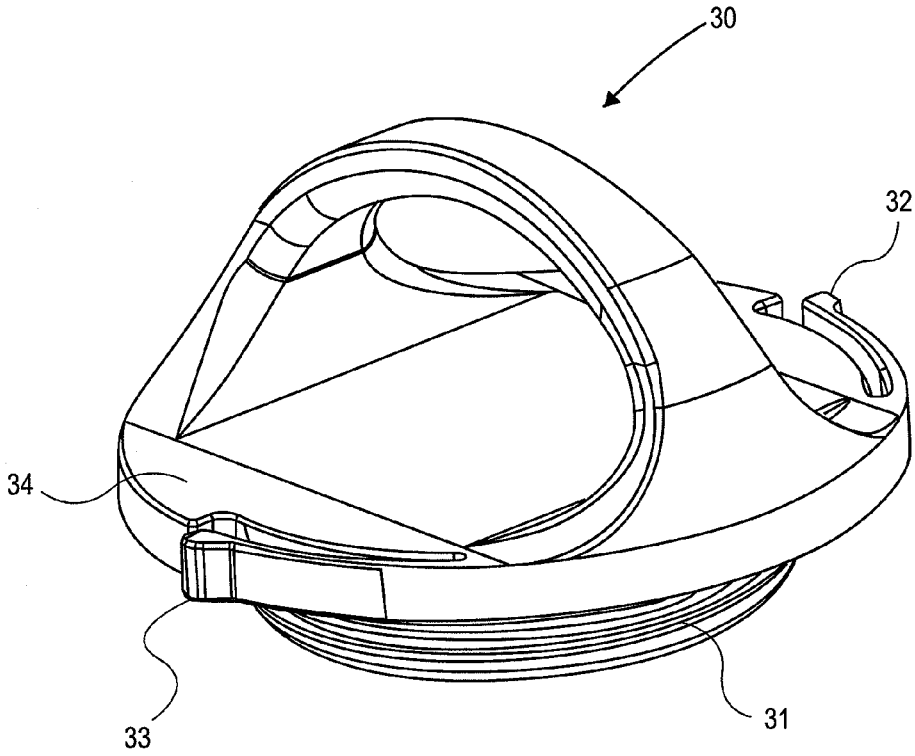
FIG. 4 is a cap of a closure assembly.
Figure 5:
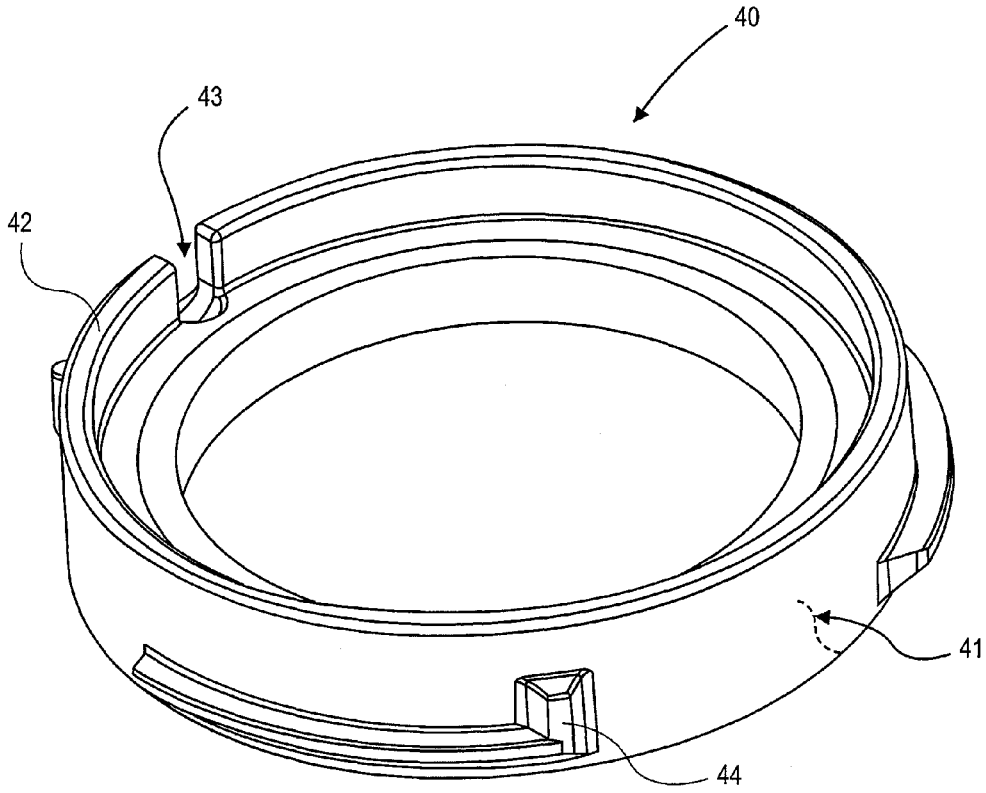
FIG. 5 is a flange component of a closure assembly.
Figure 6:
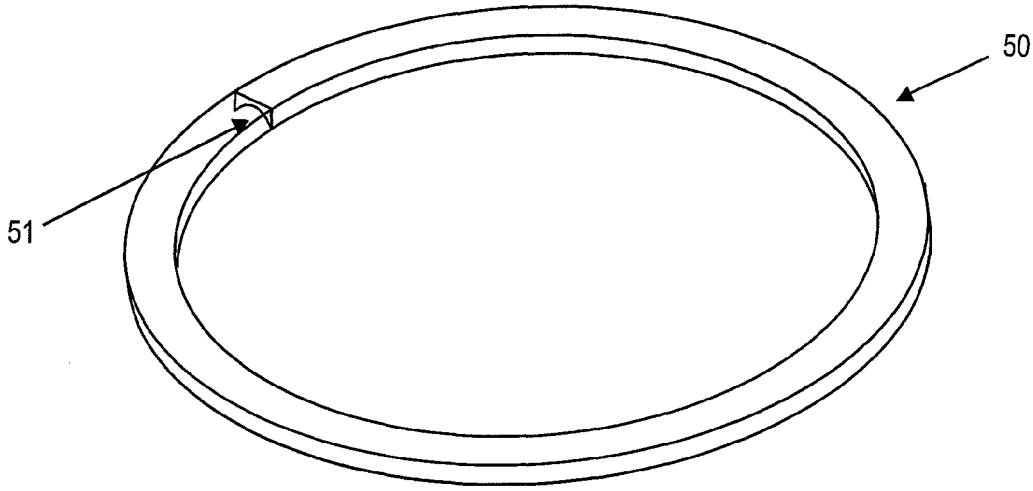
FIG. 6 is a flexible ring of a closure assembly.
Figure 7:
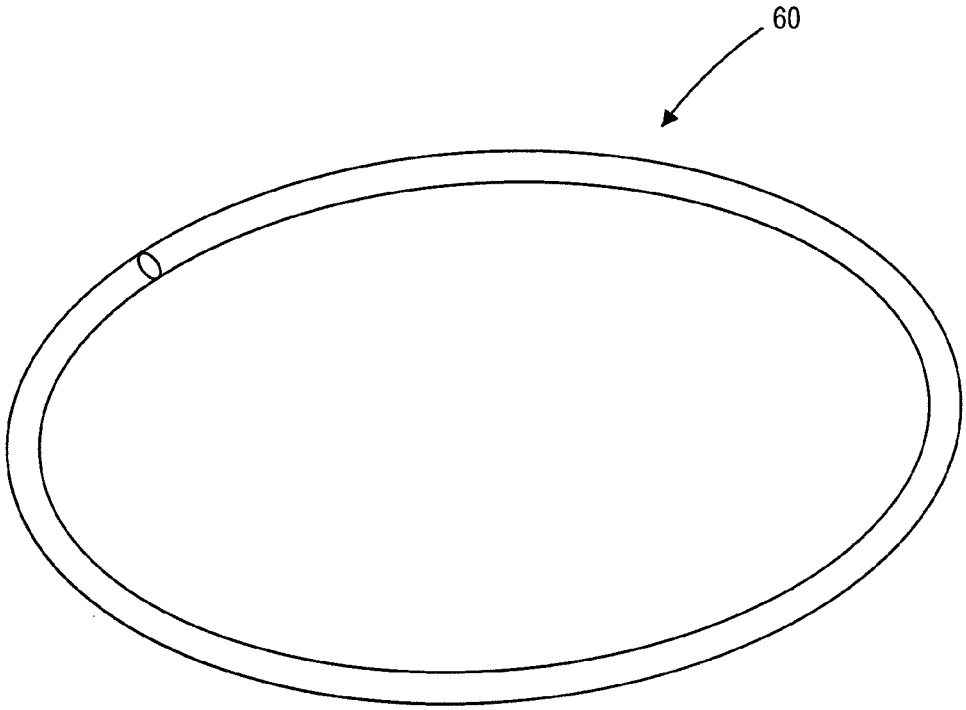
FIG. 7 is an O-ring of a closure assembly.
Figure 8:
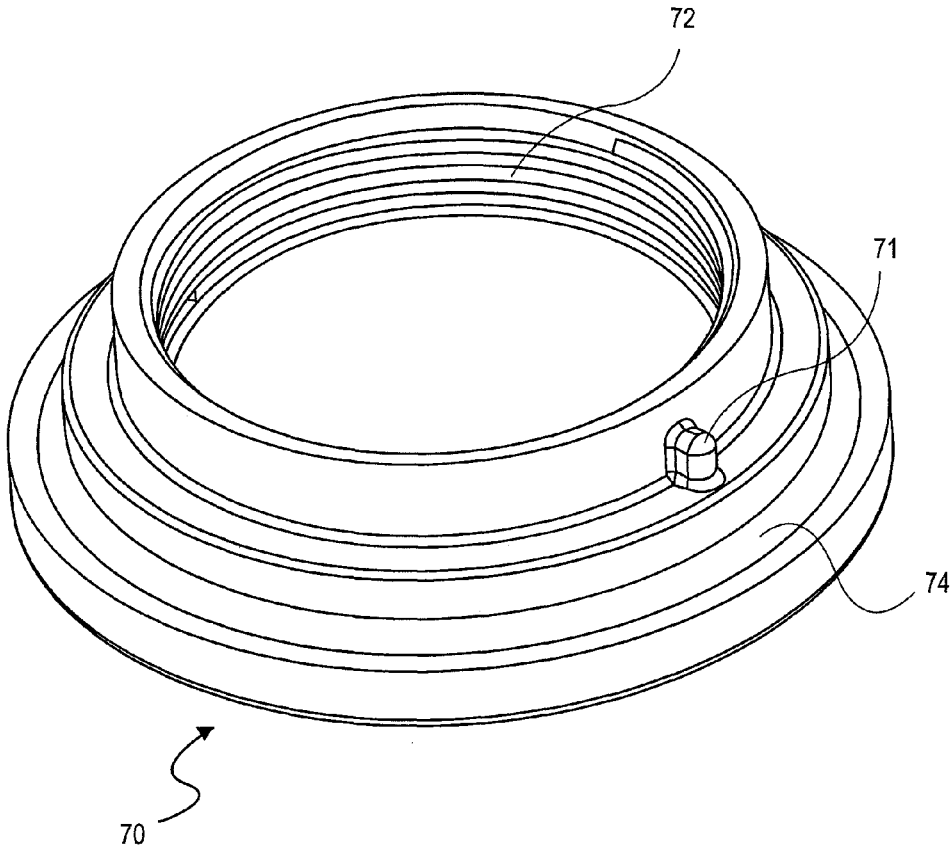
FIG. 8 is a bottom of a closure assembly.

Referring to FIG. 2, the entire length L of the adapter 10 is of the same diameter D so that it can be fully supported by a rotor cavity (not illustrated). An O-ring piston seal is created on a seal surface 11 that has an inside diameter D1 as large as possible so that any inner O-ring void would not be in fluid contact. The adapter 10 further includes a vertical surface 12 and a lug 13.

Referring to FIGS. 3 to 8, the closure assembly 20 would engage the adapter 10 in an interrupted bayonet fashion. The completeness of a closed and open position of closure is evident by a positive stop. The closure assembly 20 consists of a handle 30, flange 40, flexible ring 50, O-ring 60, and bottom 70. The O-ring 60 and flexible ring 50, its concave surface 51 adjacent to the O-ring 60, are placed onto the bottom 70. The flange 40 is then inserted onto the bottom 70 so that the key 71 engages the slot 41 on the underside of the flange 40, sandwiching the O-ring 60 and flexible ring 50 in-between. This key/slot engagement prevents a rotation of the bottom 70 relative to flange 40. The handle thread 31 of the handle 30 is threaded into a bottom thread 72 of bottom 70. The closed finger 33 and open finger 32 must be depressed inward during threading until surface 34 of the handle 30 is flush with surface 42 of the flange 40.

In operation, the closure assembly 20 is in the open position when the open finger 32 is inside a slot 43 of flange 40. In the open position, the closure assembly 20 is inserted into an opening of the adapter 10. The closure assembly will freely pass into the adapter 10 since the O-ring is not compressed. The closure assembly 20 is then rotated clockwise until the stop 44 on the flange 40 strikes the vertical surface 12 of the lug 13 on adapter 10. If the closure assembly 20 is rotated further, this results in the bottom 70 to be drawn upward until the closed finger 33 comes to a firm stop in the slot 43 of the flange 40 providing a transverse squeeze on the O-ring 60 to effect the static seal.

Figure 9:
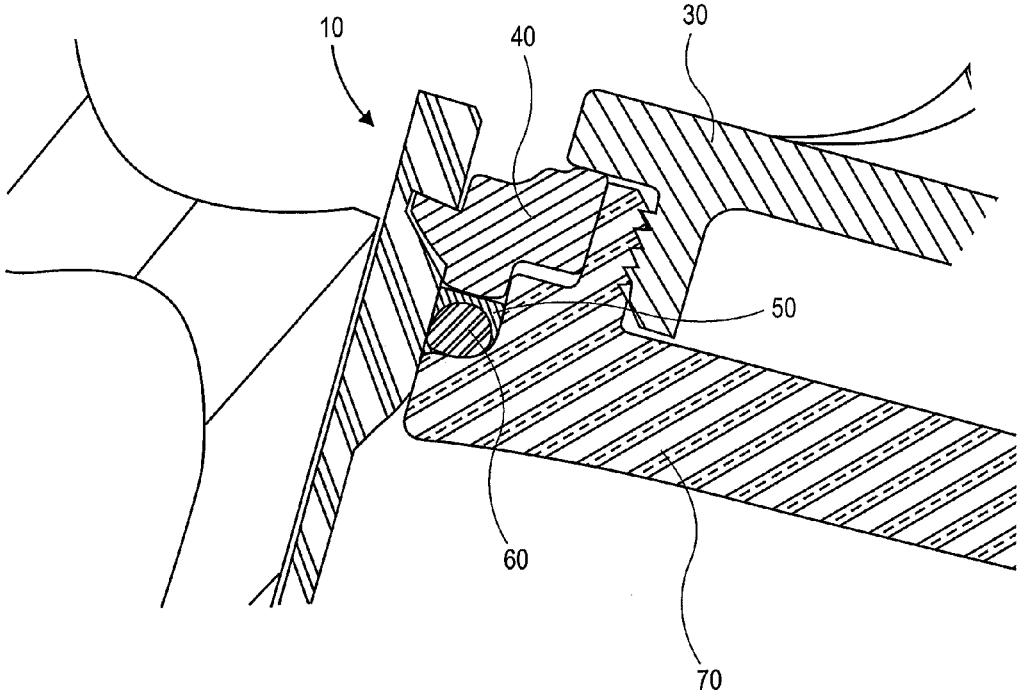
FIG. 9 is a cross-sectional view of the closure assembly showing components of the O-ring in a static closed position.
Figure 11:
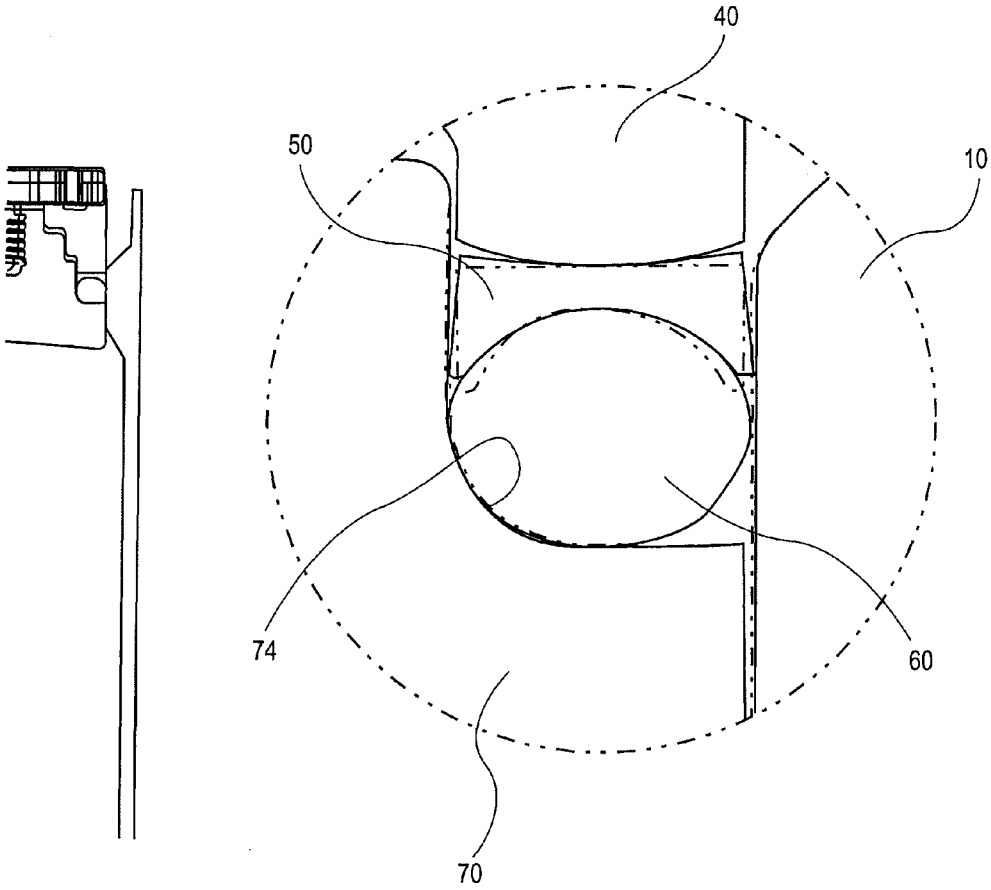
FIG. 11 is an enlarged cross-sectional view of the O-ring and the flexible ring of the closure in a dynamic closed position wherein they are subjected to fluid pressure.

Referring to FIG. 9, the compressed O-ring 60 effects the static seal. In FIG. 11, the flexible ring 50 is depicted in phantom lines for the static seal position.

Figure 10:
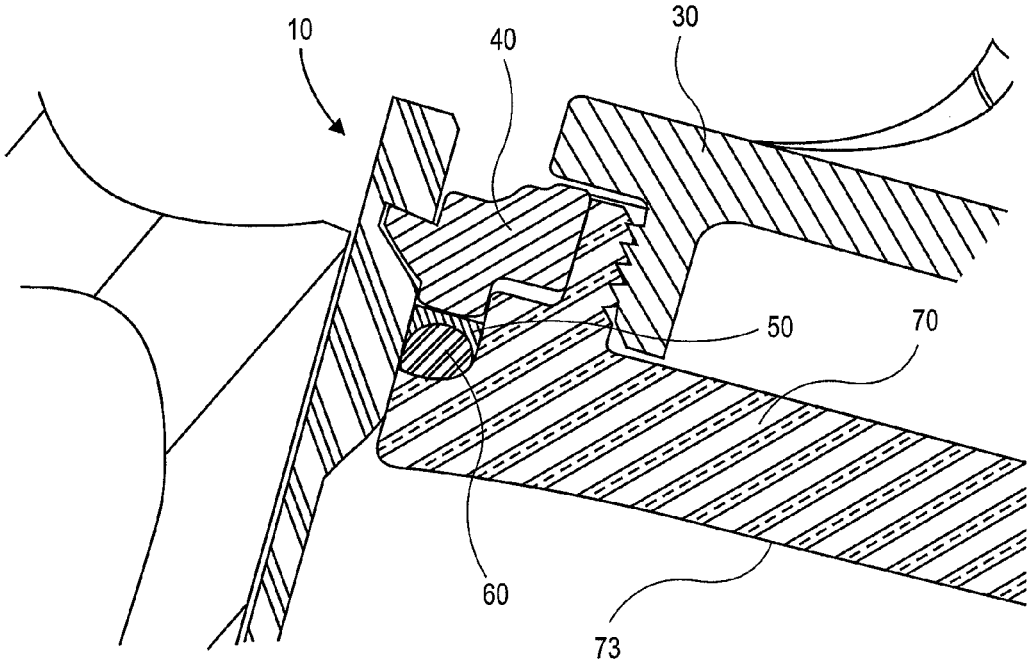
FIG. 10 is a cross-sectional view of the closure assembly showing components and the O-ring in a dynamic closed position wherein they are subjected to fluid pressure.

Referring to FIG. 10, the pressure increasing during centrifugation and acting on the underside surface 73 of the bottom 70 causes both the handle 30 and bottom 70 to move away from the fluid pressure resulting in a greater sealing force of O-ring 60 on the seal surface 11 of the adapter 10.

Again referring to FIG. 10, a more compressed O-ring 60 causes a remaining void volume to fill effecting a dynamic seal in that the greater the pressure to be sealed, the greater the resulting sealing force.

Referring to FIG. 11, the flexible ring 50 is depicted in solid lines in the dynamic seal position. In this position the flexible ring 50 completely encapsulates the O-ring 60 material thus eliminating the potential for the O-ring material to extrude from the O-ring groove 74.

Although an example of the adapter 10 is shown using a closure assembly 20, it will be appreciated that other closures can be used. Also, although the adapter 10 is useful to hold sample containers, it can also be used to transport and transfer items that may be pressure sensitive or leak sensitive in nature.

The many features and advantages of the invention are apparent from the detailed specification, and thus, it is intended, on the basis of the appended claims, to cover all such features and advantages of the invention, which fall within the true spirit and scope of the invention. Furthermore, since numerous modifications and variations will readily occur to those skilled in the art, it is not intended to limit the invention to the exact construction and operation illustrated and described, and therefore, all suitable modifications and equivalents may be resorted to, falling within the scope of the invention.

The invention claimed is:

1. An adapter configured for receiving and supporting a sample container therein and for use in a laboratory centrifuge rotor, said adapter comprising:

a closed end;

an opened end; and a closure assembly, wherein the closed end and the opened end are substantially equal in diameter and the closure assembly releasably seals the opened end, and wherein the closure assembly comprises:

a handle having threads and a closed finger for locking and an open finger for unlocking the closure assembly on the container;

a flange;

a hold down ring;

a sealing ring; and a bottom support of the closure assembly having threads to releasably mate with the handle wherein the flange is configured to mate with the opened end and the hold down ring and the sealing ring are disposed between the bottom support and the flange.

2. The adapter according to claim 1, wherein the adapter is cylindrical, elliptical or trapezoid in shape.

3. The adapter according to claim 1, wherein the adapter further includes a lug surface and a vertical inner surface disposed at said opened end.

4. The adapter according to claim 1, wherein the hold down ring is a flexible material.

5. The adapter according to claim 1, wherein the sealing ring is an O-ring.

6. The adapter according to claim 1, wherein the hold down ring is concave on one side.

7. The adapter according to claim 1, wherein the flange includes at least one stop and at least one slot.

8. The adapter according to claim 1, wherein the handle includes a male threaded bottom surface.

9. The adapter according to claim 1, wherein the bottom support contains a key protrusion and a female threaded top surface.

10. A method for sealing an adapter configured for receiving and supporting a sample container therein, comprising the steps of:

providing a closure assembly comprising a handle having threads and a closed finger for locking and an open finger for unlocking the closure assembly on the container, a flange, a hold down ring, a sealing ring and a bottom support having threads to releasably mate with the handle;

placing the sealing ring on the bottom support;

placing the hold down ring on the sealing ring;

inserting the flange onto the bottom support, sandwiching the sealing ring and the hold down ring in-between;

connecting the handle to the bottom support wherein the hold down ring and the sealing ring are disposed between the bottom support and the flange; and inserting the closure assembly into an opened end of the adapter.

11. The method according to claim 10, further comprising rotating the closure assembly to a locked position to effect a static seal.

12. The method according to claim 10, wherein the sealing ring is an O-ring.

13. The method according to claim 10, wherein the hold down ring is concave on one side and is a flexible material.

14. The method according to claim 10, wherein the flange includes at least one stop and at least one slot.

15. The method according to claim 10, wherein the handle and the bottom support are complimentary threaded.

16. The method according to claim 10, wherein the bottom support includes a key protrusion.

* * * * *

UNITED STATES PATENT AND TRADEMARK OFFICE

CERTIFICATE OF CORRECTION

PATENT NO. : 8,105,556 B2
APPLICATION NO. : 11/314825
DATED : January 31, 2012
INVENTOR(S) : Romanauskas et al.

It is certified that error appears in the above-identified patent and that said Letters Patent is hereby corrected as shown below:

In column 6, line 42, claim 15, change "the bottom support are complimentary threaded." to --the bottom support are complementarily threaded.--.

Signed and Sealed this
Twenty-seventh Day of March, 2012

David J. Kappos

David J. Kappos
*Director of the United States Patent and Trademark Office*